United States Patent [19]

Varga

[11] Patent Number: 4,501,048

[45] Date of Patent: Feb. 26, 1985

[54] METHOD AND APPARATUS FOR FORMING A SLIVER

[75] Inventor: John M. Varga, Halifax, England

[73] Assignee: Carding Specialists (Canada) Ltd., Toronto, Canada

[21] Appl. No.: 422,095

[22] Filed: Sep. 23, 1982

[30] Foreign Application Priority Data

Sep. 24, 1981 [GB] United Kingdom ..... 8128884

[51] Int. Cl.[3] ..... D01G 15/46; D01H 5/72

[52] U.S. Cl. ..... 19/106 R; 19/150; 19/288

[58] Field of Search ..... 19/106 R, 150, 99, 250, 19/157, 288, 287, 292

[56] References Cited

U.S. PATENT DOCUMENTS

| | | | |
|---|---|---|---|
| 1,130,467 | 3/1915 | Bellwood et al. | 19/292 |
| 2,326,331 | 8/1943 | Chantler | 19/150 |
| 2,795,010 | 6/1957 | Hess | 19/150 X |
| 3,296,663 | 1/1967 | Reiterer | 19/106 R |
| 3,345,700 | 10/1967 | Kalwaites | 19/150 |
| 3,825,975 | 7/1974 | Staeheli | 19/150 |
| 3,946,464 | 3/1976 | Meinke et al. | 19/150 |
| 4,275,482 | 6/1981 | Leifeld | 19/150 |
| 4,389,752 | 6/1983 | Briner et al. | 19/150 X |

FOREIGN PATENT DOCUMENTS

| | | | |
|---|---|---|---|
| 2931568 | 2/1981 | Fed. Rep. of Germany . | |
| 1155598 | 6/1969 | United Kingdom . | |
| 1208264 | 10/1970 | United Kingdom . | |
| 1337165 | 11/1973 | United Kingdom | 19/150 |
| 1358262 | 7/1974 | United Kingdom | 19/106 R |
| 2056513 | 3/1981 | United Kingdom . | |

*Primary Examiner*—Louis K. Rimrodt
*Assistant Examiner*—Judith L. Kravitz
*Attorney, Agent, or Firm*—Henry Sternberg

[57] ABSTRACT

A method and apparatus for forming a sliver from a web of fibres leaving the upper part of a horizontally extending delivery roller (2) of a cotton type carding machine. The web is delivered downwardly from the upper part of the delivery roller into proximity with a surface of power driven selvedge support means, in one embodiment conveyors (9 and 10). The surface of the selvedge support means moves at a level below the upper part of the delivery roller in a direction that is generally longitudinal to the delivery roller and into a sliver-forming nip (15). The downwardly travelling web passes through the nip and tension is applied to the web by the action of the nip. The sliver is delivered from the nip (15) and may pass directly to calender rolls (27) immediately downstream of the nip. If parts of the web should break, the selvedge support means will guide these back into the nip to regain normal running.

24 Claims, 15 Drawing Figures

METHOD AND APPARATUS FOR FORMING A SLIVER

This invention relates to a method and apparatus for forming a sliver from a web of fibres leaving the upper part of a horizontally extending delivery roller of a cotton type carding machine. That roller will usually be the lower one of two delivery rollers which form a nip from which the web is delivered.

In a cotton type carding machine the web conventionally runs from a nip between delivery rollers to the condenser trumpet of a calender or autoleveller, the web condensing in width from the full width of the delivery rollers to the narrow width of the condenser trumpet. During passage along that path the web tends to be unstable, particularly if the carding engine is being run at high speed or if a lightweight web is being processed.

There have in the past been many proposals for forming a sliver at the take-off from a card and reducing the number of web or sliver breakages that require a card to be stopped. In the traditional take-off system the web travels substantially horizontally from the delivery rollers to the condensor trumpet over a considerable distance and is prone to disturbance by air flow over a large area. The degree of disturbance increases as the speed of web delivery increases and although improved web control can be achieved by increasing the draft applied to the web as delivery rate increases this is not an entirely satisfactory way of controlling the web. Another form of take-off system that is in use is collection of the web on the surface of a belt in or closely adjacent to the nip of the delivery rollers and extending to each side of the plane of the nip, the belt surface being transverse to the direction of web delivery. The full width of the web is thus collected on the surface of the belt and conveyed to the side of the card from where it is withdrawn as a sliver for further processing. This system also has disadvantages, one of which being that it is impossible to inspect the web as it leaves the delivery rollers.

According to the present invention a method for forming a sliver from a web of fibres leaving the upper part of a horizontally extending delivery roller of a cotton type carding machine comprises delivering the web downwardly from the upper part of the delivery roller into proximity with a surface of power driven selvedge support means, moving the surface of the selvedge support means at a level wholly below the uppermost part of the delivery roller in a direction that is generally longitudinal of the delivery roller and into a sliver-forming nip, delivering the downwardly-travelling web into the nip, and delivering the sliver from the nip.

Apparatus according to the invention comprises a horizontally extending delivery roller of a cotton type carding machine, from an upper part of which roller the web is delivered, selvedge support means having a surface lying wholly below the uppermost part of the delivery roller and extending in a direction that is generally longitudinal of the delivery roller and means for driving the selvedge support means to move the surface in said direction to and through a location wherein the surface forms part of a sliver forming nip into which the web passes.

In use, the web travels downwardly from the delivery roller to the nip and is there formed into a sliver.

The fact that the web is travelling downwardly reduces the number of breakages in the web as it is condensed in width. If breakage or partial breakage should occur the broken web or web section tends to fall downwardly from the delivery roller and will therefore contact the surface of the selvedge support means so that it is again restored to a condition wherein the whole of the material of the web passes into the sliver-forming nip.

For high speed application it is generally desirable that tension be applied to the web between the delivery roller and the sliver-forming nip. The driving means is therefore such that the speed of the surface through the nip is sufficient to apply tension to the web, desirably such as to draft the web by from 3% to 40%. At less than 3% draft uncontrollable billowing of the web may occur at high speeds, so leading to irretrievable web breakage. Although the upper level of permissible draft is dependent in some degree on the type of material being processed, an applied draft of 40% will often cause the web to be torn apart. This is particularly the case if, as is preferred, the level of the surface of the selvedge support means is, at least in part, above the level of the lower part of the delivery roller. The path of travel of the web is therefore short and the effect of air disturbance, which is thought to increase the draft potential of the web, is accordingly small. The generally preferred applied draft is from 5% to 30% with the range of from 10% to 18% being particularly preferred.

The application of tension to the web causes each selvedge, during normal running, to follow a substantially linear path from the area where the selvedge leaves contact with the delivery roller to where it makes contact with the surface of the selvedge support means in the nip. The selvedge support means is preferably arranged so that it lies closely adjacent to that path but desirably out of contact with the selvedge. If there is contact it should be such that the selvedge is not significantly distorted from the normal path that it would adopt in the absence of the support means.

The application of tension to the web, together with the general downward path of travel of the web, is desirably such that the selvedge and outer parts of the web are caused to maintain contact with the surface of the delivery roller over a substantial arc of that roller, desirably an arc of at least 45° and more preferably of from 60° to 90°.

Preferably a guide plate is located to the downstream side of the web path, the plate extending in height from at least the level of the sliver-forming nip to at least the level of the upper part of the delivery roller, and extending in width over at least the central one-third of the width of the delivery roller. The guide plate conveniently extends the full width of the delivery roller. As the web leaves the delivery roller at high speed then there may be a tendency for at least the central part of the web to billow in the downstream direction of travel, and a guide plate located in this position restrains such billowing and confines the web to an area from where it will be collected into the sliver-forming nip.

Preferably calender rolls are located below and in close proximity to the delivery side of the sliver-forming nip. Thus, a fully formed and calendered sliver can be delivered directly from the apparatus for further processing. If calender rolls are not provided in this location then the apparatus will include a guide for directing the sliver leaving the sliver-forming nip to remote calender rolls. Calender rolls that are in close proximity to the sliver-forming nip may be mounted together with the selvedge support means on a common support which also carries transmission means for driving the selvedge support means and calender rolls from a common drive input, so forming a particularly compact take-off unit. Condensing guides are desirably located between the sliver-forming nip and the calender rolls to guide the sliver to a required axial section of the calender rolls.

The selvedge support means may comprise one or more rollers rotatable about horizontal axes that are perpendicular to the axes of the delivery rollers. In a first embodiment two such rollers are used, drawing the web into a sliver-forming nip that is disposed centrally of the delivery rollers, or that may be offset from the centre of the delivery rollers. Such a single pair of collecting rollers need to be of large diameter in order to gather in a full width web, and it may be desirable to have auxiliary selvedge support means to each side of centrally disposed rollers, the auxiliary selvedge support means acting to direct the selvedges and outer regions of the web onto the central rollers should there be breakage of the web. The auxiliary selvedge support means may be additional rollers or conveyor belts.

In a further embodiment the selvedge support means comprises a plurality of pairs of rollers, all rotatable about horizontal axes perpendicular to the axes of the delivery rollers and each pair of rollers defining a sliver-forming nip therebetween. In this embodiment the web is laterally divided into a number of sections equal to the number of pairs of rollers, one web section passing to a corresponding one of the nips. For example, two pairs of selvedge support rollers may be used, each collecting half the total width of the web, or three pairs of collecting rollers may be used each collecting one third of the total width of the web. In this way the diameter of the rollers can be significantly reduced.

In these embodiments each roller may have a uniform cylindrical surface so that the web is gathered into the nip without attempting to give the resulting sliver any particular shape. It may be advantageous to form the roller surfaces of each pair in an interlocking manner, for example a U-shaped groove and corresponding projection or tongue and groove form in order to define a channel into which the fibrous material is compacted to give a more cohesive sliver.

In preferred arrangements, however, the selvedge support means may comprise at least one conveyor belt, the upper surface of which extends wholly below the level of the uppermost part of the delivery roller. In this case the web is collected into a sliver-forming nip formed between the conveyor belt and another element forming the nip, which other element may be either a further conveyor belt or a roller. A single conveyor belt may extend the full width of the delivery rollers to give side delivery of the web, two conveyor belts may each cover substantially half the width of the delivery rollers to converge the web to a central nip, or conveyor belts may be arranged so that the web is divided and one part of the web is collected by a conveyor belt leading to a first nip and a further part of the web is collected by a conveyor belt leading to a second nip.

From the forgoing discussion it will be understood that arrangements of conveyor belts, of rollers or of conveyor belts and rollers may be designed to suit the particular delivery roller and equipment from which the web is delivered.

The invention will be better understood from the following description of specific embodiments thereof, given with reference to the accompanying drawings in which.

Figure 1:
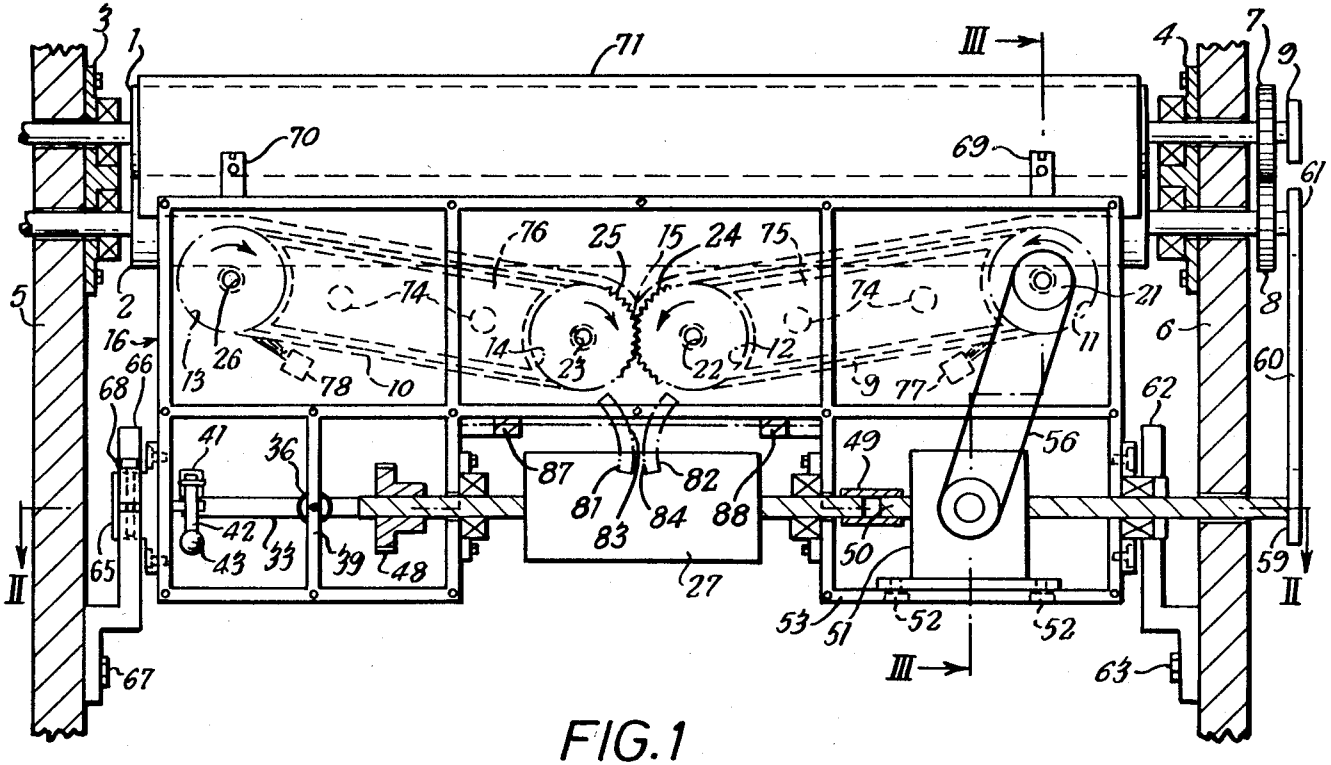
FIG. 1 is a front elevation with parts removed and other parts sectioned of a first form of apparatus.
Figure 2:
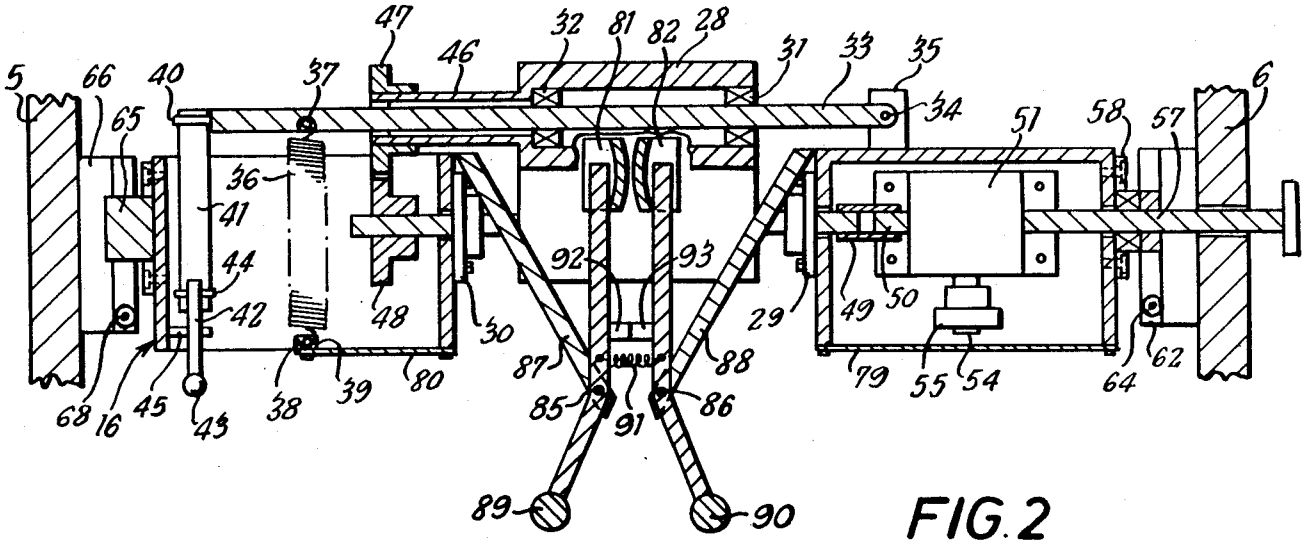
FIG. 2 is a cross-section taken on the line II—II of FIG. 1.
Figure 3:
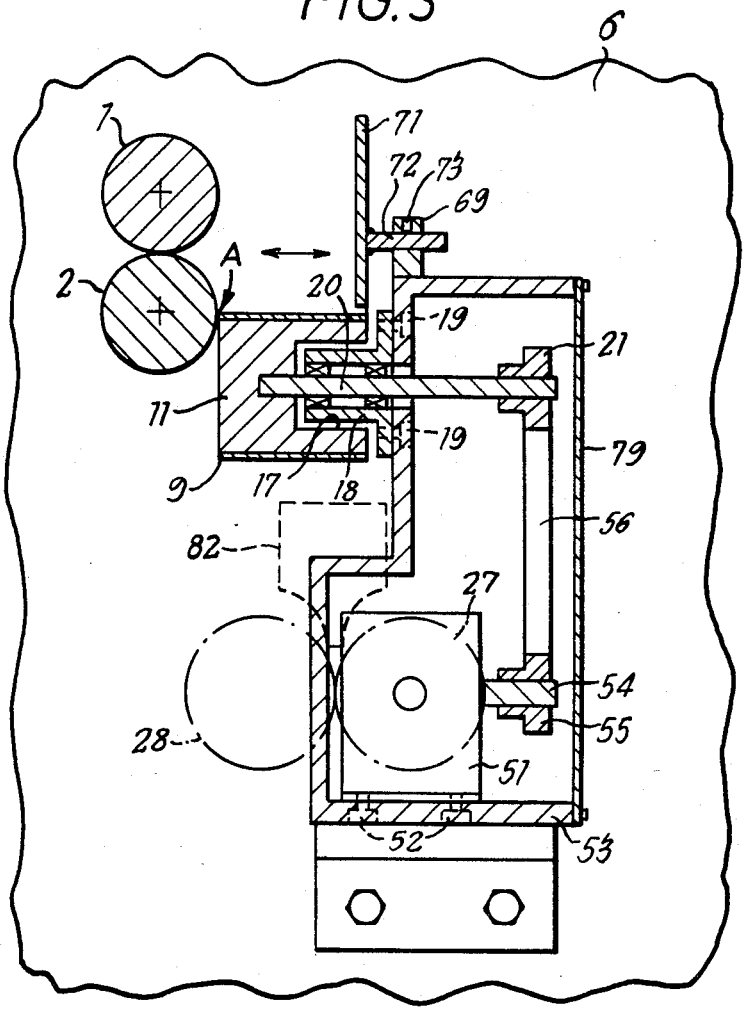
FIG. 3 is a cross-section taken on the line III—III of FIG. 1.

Referring now to FIGS. 1 to 3 these show delivery rollers 1, 2 of a high speed card, which is itself not shown in the drawings. The delivery rollers are supported in bearing assemblies 3, 4 which are respectively secured to frame elements 5, 6 at opposite sides of the card. Shafts carrying the delivery rollers are coupled together by gears 7, 8 and are driven by drive to a pulley 9 on the shaft of the roller 1. The delivery rolls shown are in the form of smoothsurfaced crush rolls, although it will be understood that any final, horizontally-extending take-off roller or rollers may be present in this location.

Located below the level of the upper part of the lower delivery roller 2 are two conveyor belts 9, 10 carried respectively by rollers 11, 12 and 13, 14. The belts meet in a nip 15 and are disposed so that their upper surfaces slope downwardly into the nip. The rollers 11 to 14 are each rotatably mounted on a fabricated support 16. Each of the rollers is generally of the form shown for roller 11 in FIG. 3, having a recess 17 into which projects a bearing housing 18 secured by bolts 19 to the support 16. Bearings in the housing 18 support a spindle 20 to which the body of the roller 11 is secured by any convenient means. The spindle 20 of roller 11 carries a drive pulley 21 as will further be described later. Corresponding spindles 22 and 23 of rollers 12 and 14 carry gears 24, 25 which are in mesh and thus couple the rollers together. The spindle 26 of roller 13 is simply supported by its respective bearings.

A pair of calender rolls 27, 28 are located beneath the nip of the conveyor belts. For convenience the outline of the position of these calender rolls is shown in phantom in FIG. 3, although of course, the rolls themselves are not visible in that figure. The calender roll 27 is mounted on a shaft 28 which is supported by bearings in bearing housings 29, 30 bolted to respective parts of the support 16. The calender roll 28 is supported by bearings 31, 32 on a rod 33 that is pivotally mounted at 34 on a clevis member 35 secured to the support 16. A tension spring 36 is secured at 37 to the rod 33 and is secured at 38 to part 39 of the support 16. The rod 33 is, at its free end, pivoted at 40 to one member 41 of a toggle lever system having a further member 42 terminating in a knob 43. The members 41 and 42 are pivoted together at 44 and member 42 is additionally pivoted about a pivot 45 secured to the support 16. The spring 36 acts to hold the two calender rolls in contact, while the toggle can, when required, be operated to separate the two calender rolls for cleaning or other purposes.

The calender roll 28 has a hollow sleeve extension 46, to the end of which is secured a gear 47 in mesh with a gear 48 secured to the shaft 28 of the calender roll 27. Drive from roll 27 is thus transmitted to roll 28. The opposite end of the shaft 28 of the roll 27 is coupled by a sleeve coupling 49 to a first output shaft 50 from a bevel box 51 secured by bolts 52 to a part 53 of the support 16. A second output shaft 54 from the bevel box carries a pulley 55 from which a belt 56 extends to the pulley 21 associated with the roller 11. An input shaft 57 to the bevel box is supported by a bearing in a bearing housing 58 bolted to the support 16 and extends through the card frame member 6. The shaft 57 carries a pulley 59 connected by a belt 60 to a pulley 61 on the shaft of the delivery roller 2.

The bearing housing 58 is pivotally supported in a split housing 62 secured by bolts 63 to the frame member 6. The two parts of the split housing can be locked together by a bolt 64. At the opposite side to the bearing housing 58 the carrier 16 has secured thereto a mount 65 received in a split housing 66 secured by bolts 67 to the frame member 5. Again, the split housing 66 can be secured by a bolt 68. The axes of the two split housings are aligned and as a result of this mounting the whole of the support 16 together with the conveyor belts, calender rolls and drive transmission that are carried thereon can be pivoted to move the conveyor belts towards or away from the delivery rollers generally as indicated by the double-ended arrow in FIG. 3.

The upper part of the support 16 has two lugs 69, 70 welded or otherwise secured thereto. A guide plate 71 carries two pins such as 72 each of which is received in an opening in the lug 69 and which can be secured in position in that opening by a grub screw 73. The upper edge of the guide plate 71 lies above the level of the top delivery roller 1, while the lower edge of the guide plate 71 is shaped to follow generally the contour of the conveyor belts and the nip formed thereby, and to lie just above the level of the surface of the conveyor belts. Guide plate 71 as a whole is positioned to the downstream side of the web path and the spacing between it and the delivery rollers can be adjusted by loosening the grub screws 73.

The carrier 16 carries on its front face projections 74 to which may be secured respective shields 75, 76 each closing the open space within the respective conveyor belt adjacent the delivery rollers and thus preventing the entry of dust into that space. The carrier also supports mounts 77, 78 for brushes which engage the conveyor surface on its return run, the brushes contacting the conveyors in a trailing direction. The brushes ensure that the conveyor surface is clean before it enters the possible web contact region.

The carrier 16, as is apparent from the drawings, comprises various frame members which form compartments in which are located various elements of the different drive transmissions. Those compartments are generally closed by cover plates such as 79, 80 bolted or otherwise secured to the support 16.

In operation, the carrier 16 is first adjusted in the split housings 62, 66 to locate the belts as required in relation to the delivery rollers 1 and 2. The most usual position will be with the outer part of the upper surface of each belt in contact with or closely adjacent to the surface of the delivery roller 2 at the mid level thereof as indicated at A in FIG. 3. The bolts of the split housing are then tightened in order to lock the carrier relative to the card frame in the set position. The delivery rollers 1 and 2 are driven to deliver a carded web therefrom. From the pulley 61 on the shaft of the delivery roller 2 the belt 60 transmits drive to the pulley 59 and thence to the bevel box 51. The pulley 55, belt 56 and pulley 21 transmit drive to the roller 11 and the conveyor belt 9 in turn transmits drive, to the roller 12. The cooperating gears 24, 25 transmit drive from the roller 12 to the roller 14 and thence to the belt 10 and, through this belt, the roller 13. The bevel box also drives through the coupling 49 the calender roll 27 which drives through gears 48 and 47 the calender roll 28. Thus, the whole of the take-off unit is driven from a single drive supply. The web taken from the take-off rollers 1 and 2 passes downwardly to be drawn into the nip 15. The web is thus condensed in width and leaves the nip as a sliver which passes downwardly into the nip between the calender rolls 27, 28 from where the sliver can be taken for further processing. After start-up it is found that the selvedges of the condensing web are in fact only in contact with the upper surfaces of the conveyor belts in the immediate vicinity of the nip and lie slightly above the conveyor belt surfaces over the remainder of the extent of those surfaces. This occurs because the surface speed of the material through the nip is greater than the surface speed in the nip of the take-off rollers in order to apply tension to the web as it travels from the take-off rollers into the nip 15 and thus to draft the web. If for any reason breakage or partial breakage of the web should occur the broken web or part thereof falls downwardly onto the upper surface of the respective conveyor belt and is moved thereby into the sliver-forming nip 15. This movement thus gathers the broken section back to the nip so that the web is restored to its original form and normal running recommences.

It is found that the draft that needs to be applied to the web to ensure good delivery at high speed is from 3% to 40%, more preferably from 5% to 30% and particularly 10% to 18%. The draft may be constant due to fixed gearing in the transmission, or the transmission may include means whereby the surface speeds of the conveyors and the calender rolls may be varied with respect to the surface speeds of the delivery rollers 1 and 2.

The application of draft and the general downward path of travel of the web cause the selvedge and outer parts of the web to maintain contact with the surface of the lower delivery roller 2 over a substantial arc of that roller, desirably of at least 45° and more preferably of from 60° to 90°. Consequently there is a relatively short passage in air of the selvedge and outer parts of the web, and the degree of web control resulting from the applied draft is very high. Indeed, it has surprisingly been found that the degree of sliver regularity resulting from the apparatus described, as measured by the U% (coefficient of variation of sliver count) is greatly improved in comparison to other web take-off devices. Improvement is also found in other embodiments of the invention where the web is caused to maintain a substantial arc of contact with the delivery roller before being taken to a sliver-forming nip.

FIGS. 1 to 3 also show the use of condensing guides 81, 82 which may facilitate piecing-up of the apparatus. The two guides have curved sliver guide surfaces 83, 84 which converge towards the centre of the calender rolls and extend between those rolls towards their nip. During normal running the guides thus condense the sliver axially of the calender rolls and guide the sliver to the axial centre section of the calender rolls to ensure that a well-compacted sliver leaves those rolls.

Each of the guides 81, 82 is mounted at one end of an arm 83, 84 respectively, the arms being pivoted at 85, 86 on respective supports 87, 88 welded or otherwise secured to the suport 16. The opposite ends of the arms carry handles 89, 90 respectively. The arms are biased to the position shown in FIG. 2 by a tension spring 91, and stop members 92, 93 which may be adjustable, limit pivotal movement of the arms to establish the distance between the confronting guide surfaces during normal running. When piecing-up the apparatus the two handles 89, 90 are moved together so pivoting the arms and separating the condensing guides to establish a broad sliver-catchment area downstream of the conveyor belt nip. The sliver travels freely through this broad area to be caught by the calender rolls and fed automatically into the nip thereof. The arms can then be gradually released to condense the sliver axially and guide it to the centre section of the calender rolls for normal running.

Figure 4:
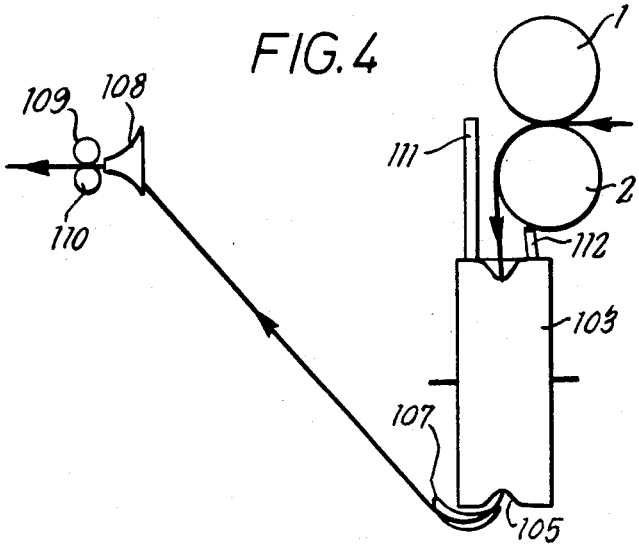
FIGS. 4 and 5 are respectively schematic side and front elevations of a second embodiment of apparatus.
Figure 5:
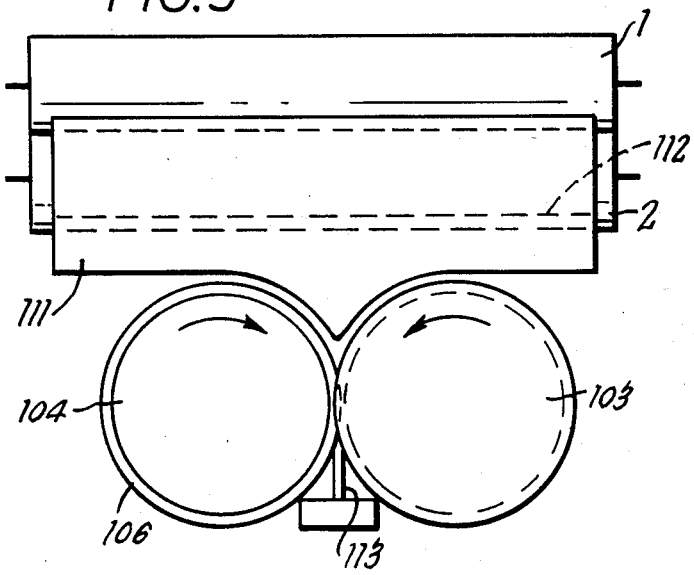

Referring now to FIGS. 4 and 5 these show schematically a further form of the apparatus according to the invention for controlling a web passing from delivery rollers 1, 2 of a high speed card. Located beneath the take-off rollers is a pair of selvedge support collecting rollers 103, 104, each rotatable about a horizontal axis perpendicular to the axis of rotation of the take-off rollers and defining a nip therebetween. The roller 103 is formed with a circumferentially extending U-shaped groove 105, and a rib 106 extends circumferentially around the roller 104 and extends into, but does not completely fill the groove 105. Below the nip of the rollers 103 and 104 is a curved guide member 107 and level with the nip of the take-off rollers is a final condensing means in the form of a conventional trumpet 108 and associated pair of tongue and groove calender or auto-leveller rolls 109 and 110. A downstream guide plate 111 is vertically positioned downstream of the web direction and is of an area such as to be substantially co-extensive with the area between the take-off roller nip and the nip between the collecting rollers 103 and 104. An upstream guide plate 112 may also be present, of the same shape as the lower part of the downstream guide plate 111. The two plates will confine the web axially of the collecting rollers 103 and 104.

In use the web taken from the take-off rollers 1 and 2 passes substantially vertically downwardly into contact with the surfaces of the collecting rollers 103 and 104 towards the nip region thereof. Those rollers are rotated in such direction as to draw the sides of the web inwardly towards the nip of the rollers and as a result thereof the web is condensed in width to pass into the nip between the collecting rollers 103 and 104. During such passage the web is compressed into the groove 10 to emerge from the nip as a cohesive sliver 113. That sliver passes around the guide 107 and into the trumpet 108, travelling thence to the condenser or auto-leveller as required.

The collecting rollers 103 and 104 are driven at a speed such that the surface speed through the nip therebetween is greater than the surface speed in the nip of the take-off rollers 1 and 2. As a result, positive draft is applied to the web as it travels from the take-off rollers to the collecting rollers. The delivery rollers 103 and 104 are conveniently driven from the drive system of the carding engine and the speed ratio between the take-off rollers and the collecting rollers may be either fixed or may be capable of variation.

As with the embodiment of FIGS. 1 to 3 the application of draft to the web as it passes between the two nips, combined with the downward passage of travel of the web is found in itself to reduce the number of breakages or partial breakages of the web. If, however, such breakage does occur the broken web or part thereof tendsto fall downwardly from the nip between the take-off rolls 1, 2 and will thus contact the appropriate rotating surface of the rollers 103 and 104. The movement of that surface will gather the broken section back into the nip so that the web is restored to its original form. To ensure that this occurs the collecting rollers 103 and 104 must clearly be of large diameter so that they are able to effect web collection across substantially the full width of the take-off rollers. This arrangement may therefore present space problems and alternative more compact arrangements that may be preferred are shown in the ensuing Figures, all of which are schematic front elevations and in all of which a pair of horizontally extending delivery rollers are shown as 1 and 2 respectively.

Figure 6:
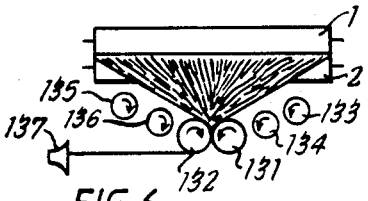
FIGS. 6 to 15 are views corresponding to FIG. 5 of further alternative embodiments.
Figure 7:
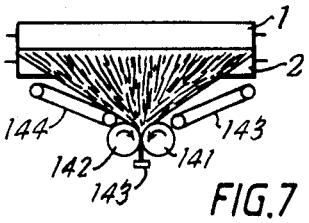

Referring to FIG. 6 this shows two central collecting rollers 131 and 132 forming a nip therebetween. Auxiliary rollers 133 and 134 are positioned to the outside of collecting roller 131 and auxiliary rollers 135 and 136 are positioned to the outside of collecting roller 132. The auxiliary rollers assist in the gathering in and conveying of the edges of the web into contact with the collecting surface of the rollers 131 and 132 during piecing-up and should the web break. The sliver issuing from between the collecting rollers 131 and 132 is taken to the side of the card into a trumpet 137, and thence to a calender or auto-leveller as required. In the embodiment of FIG. 7 two central collecting rollers 141 and 142 are used defining a nip therebetween. An auxiliary conveyor 143 lies outside the collecting roller 141 and an auxiliary conveyor 144 lies to the outside of the collecting roller 142, each conveyor having a downwardly and inwardly inclined upper surface and being driven in the direction as shown by the arrow. Accordingly, the auxiliary conveyors assist in gathering in the edges of the web and in directing the web onto the collecting surfaces of the rollers 141 and 142 during piecing-up and should the web break. In this embodiment the resulting sliver is shown as being taken round a guide 145 and thence along a path extending centrally of the card into an appropriate condenser trumpet.

Figure 8:
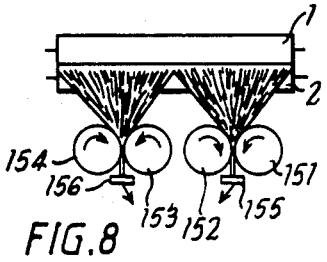
Figure 9:
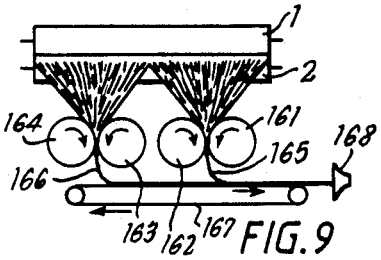

FIG. 8 shows an arrangement utilising two pairs of collector rollers, the pair 151 and 152 defining a first nip and the pair 153 and 154 defining a second nip. A web that has conveniently been divided into two equal sections by rings on the doffer in any conventional manner issues from the take-off rolls 1, 2 with one half of the web being collected into the nip between rollers 151 and 152 and the other half being collected into the nip between rollers 153 and 154. In each case the sliver issuing from each nip passes around a respective guide member 155, 156 and the two slivers are brought together into a condenser trumpet positioned downstream of the take-off rollers in similar manner to that shown in FIG. 4. In the embodiment of FIG. 9 two pairs of collector rollers 161, 162 and 163, 164 are used, each collecting half of the web into their respective nips as with FIG. 8. In this case, however, the two slivers 165, 166 emerging from the nips are collected on the upper surface of a conveyor belt 167 and are delivered to the side of the card into a condenser trumpet 168. By arranging for the two slivers to fall onto a conveyor belt and combining the two slivers on that conveyor belt it is found that sliver breakage can substantially be reduced in addition to the reduction of web breakage.

Figure 10:
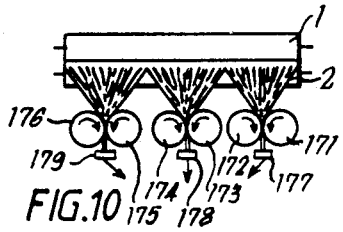

FIG. 10 shows an embodiment utilising three pairs of collector rollers 171, 172, 173, 174 and 175, 176 respectively. Accordingly, the web is divided into three sections, each gathered into one of the respective nips and the resulting fibres are passed round guides 177, 178, 179 and taken to converge into a condenser trumpet positioned downstream of the take-off rollers. It will be understood that pairs of collector rollers in excess of three may be utilised if required.

The embodiments of FIGS. 4 to 10 illustrate various ways in which the sliver or slivers issuing from the nip or nips of the collector rollers are taken to the condenser trumpet. It will be understood that these arrangements are interchangeable and that in any of the illustrated embodiments the final take-off of the slivers may be either individually to downstream condenser trumpets, selectively to one or more downstream trumpets or by side delivery, either directly from one of the collector rollers or by way of deposit from those rollers onto a conveyor belt. Side take-off from a single collector nip will be to a single side of the card; side take-off from a plurality of nips may either be to separate sides of the card or all slivers may be combined to be taken to a single side of the card. Any one of the embodiments shown may have an appropriately shaped downstream guide plate located in a similar position to the plate 111 shown in FIG. 4, and may also have an upstream guide plate positioned similarly to the plate 112 shown in FIG. 4.

Any pair of collecting rollers used in the embodiments of FIGS. 6 to 10 may be either smooth surfaced or formed with mating circumferentially extacting projections and grooves respectively in order that the sliver is compacted as it passes through the nip. Any of the collecting rollers and any auxiliary rollers or conveyors that may be present may have means for cleaning the roller surface, for example a cleaning pad bearing against an arc of the roller surface that does not form part of the collecting surface.

Figure 11:
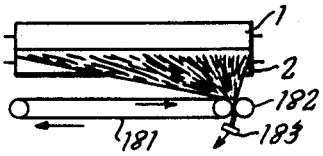

In the embodiment shown in FIG. 11 the selvedge support surface is formed by the upper run of a conveyor belt 181 positioned below the take-off rollers and extending longitudinally thereof. One of the return rollers of the conveyor belt cooperates with a roller 182 to form a nip, and by the combined action of this roller and the conveyor belt the web is collected into that nip. The sliver so formed passes round a guide 183 and is taken to a condenser trumpet downstream of the take-off roller.

Figure 12:
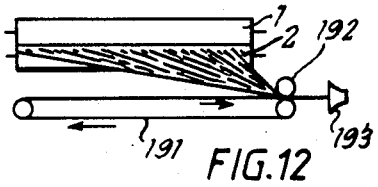

FIG. 12 shows a similar embodiment but with a side take-off system, the conveyor belt 191 being extended beyond the ends of the take-off rollers and cooperating with a roller 192 to form a nip from which the resultant sliver is taken to a condenser trumpet 193.

Figure 13:
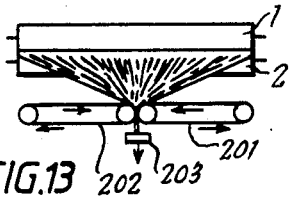

In the embodiment of FIG. 13 two conveyor belts 201 and 202 are positioned below the nip of the take-off rolls, the conveyor belts cooperating in a single central nip. The action of the conveyor belts during piecing-up or should the web break is to draw the web into the central nip from where it passes by way of a guide 203 to a condenser trumpet positioned downstream of the take-off rollers.

Figure 14:
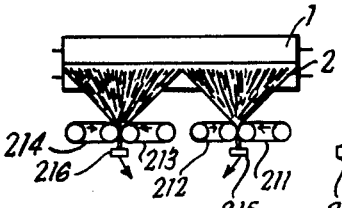

In the embodiment of FIG. 14 two pairs of collector conveyor belts 211, 212, and 213, 214 respectively are utilised, each pair forming a nip therebetween. The web is thus centrally divided, with one half being collected into one of the nips and the other half being collected into the other of the nips. The two resulting slivers pass round guides 215 and 216 and from there are taken to condenser trumpets positioned downstream of the take-off rollers.

Figure 15:
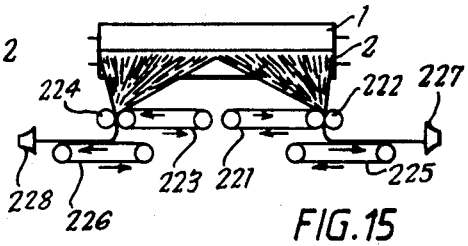

In the FIG. 15 embodiment the selvedge support means comprises a first conveyor 221 and associated roller 222 forming a nip therewith and a second conveyor 223 and associated roller 224 forming a nip therewith. Again, therefore, the web is centrally divided into two sections, one being collected into each of the two nips. The resultant slivers fall vertically onto respective conveyors 225, 226 and are respectively taken off at opposite sides of the card into condenser trumpets 227, 228.

As with the embodiments wherein the selvedge support means are formed solely by rollers the arrangements of FIGS. 11 to 15 wherein the selvedge support means are conveyor belts or a combination of conveyor belts and rollers can each be utilised with different final sliver take-off systems directing the sliver or slivers either to one or more condenser trumpets downstream of the take-off rollers or to one or more condenser trumpets at the side or sides of the card. The embodiments of FIGS. 11 to 15 may also be provided with appropriately shaped downstream guide plates and, if required, upstream guide plates positioned similarly to the guide plates 111 and 112 of FIG. 4.

In all embodiments of the invention shown in the drawings the selvedge support means, whether rollers, conveyors, or a combination of the two are disposed wholly below the level of the nip between rollers 1 and 2 although their vertical spacing from that nip may be less than or greater than that shown in the drawings. The selvedge support means are of such a width as to ensure that the web travelling downwardly from the take-off rollers is properly collected on their surfaces and guided to the nip if the web should break.

In all the illustrated embodiments of FIGS. 4 to 15 all the selvedge support rollers and/or conveyors may be driven from the drive for the carding engine and may be mounted on a common support. They may also have associated calender rollers positioned immediately downstream of the sliver-forming nip in a manner similar to that of FIGS. 1 to 3.

It will also be understood that there are many other arrangements of selvedge support means that may be utilised to collect a web passing substantially vertically downwardly from take-off rollers, the web being either collected across its full width or divided into sections, with that full width or each section being taken into a nip where draft is applied to the web.

It will also be understood that the delivery roller may be a single roller rather than a pair. If such single roller is smooth-surfaced then a pair of nip rollers will have to be located upstream thereof in order that draft may properly be applied to the web by the sliver-forming nip. In one such example the web may be delivered by smooth surfaced crush rolls from a card and travel substantially horizontally downstream to one or more smooth surfaced guide rollers round which the web is directed to pass substantially vertically to the sliver-forming nip. Other arrangements will be apparent.

I claim:

1. A method for forming a sliver from a web of fibres leaving the upper part of a horizontally extending delivery roller of a cotton type carding engine, the method comprising delivering the web downwardly from the upper part of the delivery roller into proximity with a surface of power driven selvedge support means, moving the surface of the selvedge support means at a level wholly below the uppermost part of the delivery roller in a direction that is generally longitudinal of the delivery roller and into a sliver-forming nip, delivering the downwardly-travelling web into the nip, applying tension to the web between the delivery roller and the nip, and delivering the sliver from the nip.

2. A method according to claim 1 in which the tension is such as to draft the web by from 3% to 40%.

3. A method according to claim 1 in which the tension is such as to draft the web by from 5% to 30%.

4. A method according to claim 1 in which during normal running each selvedge is caused to follow a substantially linear path from the area where the selvedge leaves contact with the delivery roller, and such path is out of contact with the selvedge support means except in the region of the sliver-forming nip.

5. A method according to claim 1 in which during normal running the selvedge and outer parts of the web are caused to maintain contact with the delivery roller over a substantial arc of that roller.

6. A method according to claim 1 in which the sliver leaving the nip is moved directly into the nip of calender rolls located below and in close proximity to the delivery side of the nip.

7. Apparatus for forming a sliver from a web of fibres, comprising a horizontally extending delivery roller of a cotton type carding machine, from an upper part of which roller the web is delivered, selvedge support means having a surface lying wholly below the uppermost part of the delivery roller and extending in a direction that is generally longitudinal of the delivery roller, and means for driving the selvedge support means to move the surface in said direction to and through a location wherein the surface forms part of a sliver-forming nip to which the web passes, said drive means being such that the speed of the surface through the nip is sufficient to cause tension to be applied to the web between the delivery roller and the nip.

8. Apparatus according to claim 7 in which the drive means is such that the tension results in the web being drafted by from 3% to 40%.

9. Apparatus according to claim 7 in which the driving means is such that the draft applied to the web is from 5% to 30%.

10. Apparatus according to claim 7 in which the relative locations and speeds of the delivery roller and the sliver forming nip are such that each web selvedge is caused to follow a substantially linear path from the area where the selvedge leaves contact with the delivery roller, and the selvedge support means are disposed to be out of contact with that path except in the region of the sliver-forming nip.

11. Apparatus according to claim 7 in which the relative locations and speeds of the delivery roller and the sliver forming nip are such that during normal running the selvedge and outer parts of the web are caused to maintain contact with the delivery roller over a substantial arc of that roller.

12. Apparatus according to claim 7 in which the delivery roller is the lower one of a pair of delivery rollers that form a nip through which the web is delivered.

13. Apparatus according to claim 7 in which a guide plate is located to the downstream side of the web path, the plate extending in height from at least the level of the sliver-forming nip to at least the level of the upper part of the delivery roller, and extending in width over at least the central one third of the width of the delivery roller.

14. Apparatus according to claim 13 in which an auxiliary guide plate is located to the upstream side of the web path, the plate extending in height from at least the level of the sliver-forming nip up to below the level of the upper part of the delivery roller.

15. Apparatus according to claim 7 in which the selvedge support means comprises a conveyor belt and said surface is the upper surface of the conveyor belt, which surface extends wholly below the level of the uppermost part of the delivery roller.

16. Apparatus according to claim 15 in which over at least the majority of its extent the upper surface of the belt lies above the level of the lower part of the delivery roller.

17. Apparatus according to claim 15 in which the selvedge support means comprises a pair of conveyor belts, the surfaces of which meet to form the sliver-forming nip.

18. Apparatus according to claim 15 in which the combined width of the conveyor belts is substantially equal to the width of the delivery roller and the silver-forming nip is ( substantially central of the delivery roller.

19. Apparatus according to claim 15 in which the upper surface of each conveyor belt slopes downwardly towards the nip in at least the region of the sliver-forming nip.

20. Apparatus according to claim 7 and including calender rolls located below and in close proximity to the delivery side of the sliver-forming nip.

21. Apparatus according to claim 20 in which the selvedge support means and the calender rolls are mounted on a common support which also carries transmission means for driving the selvedge support means and calender rollers from a common drive input.

22. Apparatus according to claim 21 in which the common support extends the full width of the delivery roller and is mounted for pivotal movement towards and away from the delivery roller about an axis parallel to that of the delivery roller.

23. Apparatus according to claim 26 in which condensing guides are located between the sliver-forming nip and the calender rolls to guide the sliver to a required axial section of the calender rolls.

24. Apparatus according to claim 23 in which the condensing guides are movable towards and away from each other.

* * * * *